US010223951B2

(12) United States Patent
Shang et al.

(10) Patent No.: US 10,223,951 B2
(45) Date of Patent: Mar. 5, 2019

(54) SCANNING DIRECTION CONTROL CIRCUIT, DRIVING METHOD THEREOF, LIGHT-ON TESTING DEVICE AND DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Hao Shang, Beijing (CN); Zhidong Yuan, Beijing (CN); Tao Zhang, Beijing (CN)

(73) Assignees: BOE TECHNOLOGY GROUP CO., LTD. (CN); HEFEI XINSHENG OPTOELECTRONICS TECHNOLOGY CO., LTD (CN)

( * ) Notice: Subject to any disclaimer, the term of this patent is extended or adjusted under 35 U.S.C. 154(b) by 0 days.

(21) Appl. No.: 15/825,885

(22) Filed: Nov. 29, 2017

(65) Prior Publication Data

US 2018/0308404 A1 Oct. 25, 2018

(30) Foreign Application Priority Data

Apr. 19, 2017 (CN) ..... 2017 1 0256895

(51) Int. Cl.

| | |
|---|---|
| ***G09G 3/32*** | (2016.01) |
| ***G09G 3/00*** | (2006.01) |
| ***G09G 3/3266*** | (2016.01) |

(52) U.S. Cl.

CPC ..... *G09G 3/006* (2013.01); *G09G 3/3266* (2013.01); *G09G 2310/0202* (2013.01); *G09G 2310/08* (2013.01)

(58) Field of Classification Search

None

See application file for complete search history.

(56) References Cited

U.S. PATENT DOCUMENTS

| | | | | |
|---|---|---|---|---|
| 2004/0100304 | A1* | 5/2004 | Kawase | G09G 3/3225 326/86 |
| 2017/0124974 | A1* | 5/2017 | Cao | G11C 19/28 |
| 2017/0162149 | A1* | 6/2017 | Zhao | G09G 3/3677 |
| 2018/0190179 | A1* | 7/2018 | Zhao | G09G 3/2092 |

* cited by examiner

*Primary Examiner* — Joseph R Haley

(74) *Attorney, Agent, or Firm* — Brooks Kushman P.C.

(57) ABSTRACT

A scanning direction control circuit includes a selection control circuit configured to output a first control signal to a start signal reception control circuit and output a second control signal to a direction control circuit; the start signal reception control circuit configured to, under the control of the first control signal, enable a scanning pulse signal input end to be electrically coupled to a forward scanning start signal input end during forward scanning, and enable the scanning pulse signal input end to be electrically coupled to a backward scanning start signal input end during backward scanning; and the direction control circuit configured to, under the control of the second control signal, output a forward scanning control signal to a scanning direction control end during forward scanning, and output a backward scanning control signal to the scanning direction control end during backward scanning.

15 Claims, 3 Drawing Sheets

SCANNING DIRECTION CONTROL CIRCUIT, DRIVING METHOD THEREOF, LIGHT-ON TESTING DEVICE AND DISPLAY DEVICE

CROSS-REFERENCE TO RELATED APPLICATION

This application claims priority to Chinese Patent Application No. 201710256895.9 filed on Apr. 19, 2017, which is incorporated herein by reference in its entirety.

TECHNICAL FIELD

The present disclosure relates to the field of display technology, in particular to a scanning direction control circuit, a method for driving the scanning direction control circuit, a light-on testing device and a display device.

BACKGROUND

During the manufacture of a conventional organic light-emitting diode (OLED) display product, pin miss (i.e., a situation where a pin of a chip is installed at an incorrect position or coupled inaccurately) may frequently occur during a module binding operation, and during the manufacture of a module, many defects may occur. A light-on test for the module is very important for a subsequent reworking operation.

SUMMARY

In one aspect, the present disclosure provides in some embodiments a scanning direction control circuit for controlling a scanning direction of a gate driving circuit. The gate driving circuit includes a forward scanning start signal input end, a backward scanning start signal input end and a scanning direction control end. The scanning direction control circuit includes a selection control circuit, a start signal reception control circuit and a direction control circuit. The selection control circuit is configured to output a first control signal to the start signal reception control circuit and output a second control signal to the direction control circuit. The start signal reception control circuit is configured to, under the control of the first control signal, enable a scanning pulse signal input end to be electrically coupled to the forward scanning start signal input end during forward scanning, and enable the scanning pulse signal input end to be electrically coupled to the backward scanning start signal input end during backward scanning. The direction control circuit is configured to, under the control of the second control signal, output a forward scanning control signal to the scanning direction control end during forward scanning, and output a backward scanning control signal to the scanning direction control end during backward scanning.

In a possible embodiment of the present disclosure, the selection control circuit, the start signal reception control circuit and the direction control circuit are arranged on a same time control circuit board.

In a possible embodiment of the present disclosure, the selection control circuit includes a selection switching module and a phase inversion module. A first input end of the selection switching module is configured to receive a high level signal, a second input end thereof is configured to receive a low level signal, and an output end thereof is coupled to an input end of the phase inversion module. The input end and an output end of the phase inversion module are coupled to the start signal reception control circuit, and the output end of the phase inversion module is further coupled to the direction control circuit. The selection switching module is configured to enable the first input end or the second input end to be electrically coupled to the output end of the selection switching module.

In a possible embodiment of the present disclosure, the start signal reception control circuit includes: a first D trigger, an input end of which is coupled to the scanning pulse signal input end, an enabling end of which is coupled to the output end of the selection switching module, and an output end of which is coupled to the forward scanning start signal input end; and a second D trigger, an input end of which is coupled to the scanning pulse signal input end, an enabling end of which is coupled to the output end of the phase inversion module, and an output end of which is coupled to the backward scanning start signal input end.

In a possible embodiment of the present disclosure, the direction control circuit includes an AND gate module, a first input end of which is coupled to a scanning direction control signal input end, a second input end is coupled to the output end of the selection switching module, and an output end of which is coupled to the scanning direction control end.

In a possible embodiment of the present disclosure, when the gate driving circuit includes a left-side gate driving circuit and a right-side gate driving circuit, the scanning direction control signal input end includes a left-side scanning direction control signal input end and a right-side scanning direction control signal input end, and the scanning direction control end includes a left-side scanning direction control end and a right-side scanning direction control end. The AND gate module includes: a first AND gate, a first input end of which is coupled to the left-side scanning direction control signal input end, a second input end of which is coupled to the output end of the selection switching module, and an output end of which is coupled to the left-side scanning direction control end; and a second AND gate, a first input end of which is coupled to the right-side scanning direction control signal input end, a second input end of which is coupled to the output end of the selection switching module, and an output end of which is coupled to the right-side scanning direction control end.

In another aspect, the present disclosure provides in some embodiments a method for driving the above-mentioned scanning direction control circuit, including steps of: outputting, by a selection control circuit, a first control signal to a start signal reception control circuit and a second control signal to a direction control circuit; under the control of the first control signal, enabling, by the start signal reception control circuit, a scanning pulse signal input end to be electrically coupled to a forward scanning start signal input end during forward scanning, and enabling, by the start signal reception control signal, the scanning pulse signal input end to be electrically coupled to a backward scanning start signal input end during backward scanning; and under the control of the second control signal, outputting, by the direction control circuit, a forward scanning control signal to a scanning direction control end during forward scanning, and outputting, by the direction control circuit, a backward scanning control signal to the scanning direction control end during backward scanning.

In yet another aspect, the present disclosure provides in some embodiments a light-on testing device for performing a light-on test through controlling a gate driving circuit. The gate driving circuit includes a forward scanning start signal input end, a backward scanning start signal input end and a scanning direction control end. The light-on testing device includes the above-mentioned scanning direction control circuit. The scanning direction control circuit is coupled to the forward scanning start signal input end, the backward scanning start signal input end and the scanning direction control end.

In a possible embodiment of the present disclosure, the light-on testing device further includes a time control circuit board on which a selection control circuit, a start signal reception control circuit and a direction circuit are arranged.

In still yet another aspect, the present disclosure provides in some embodiments a display device including the above-mentioned scanning direction control circuit.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Figure 1:
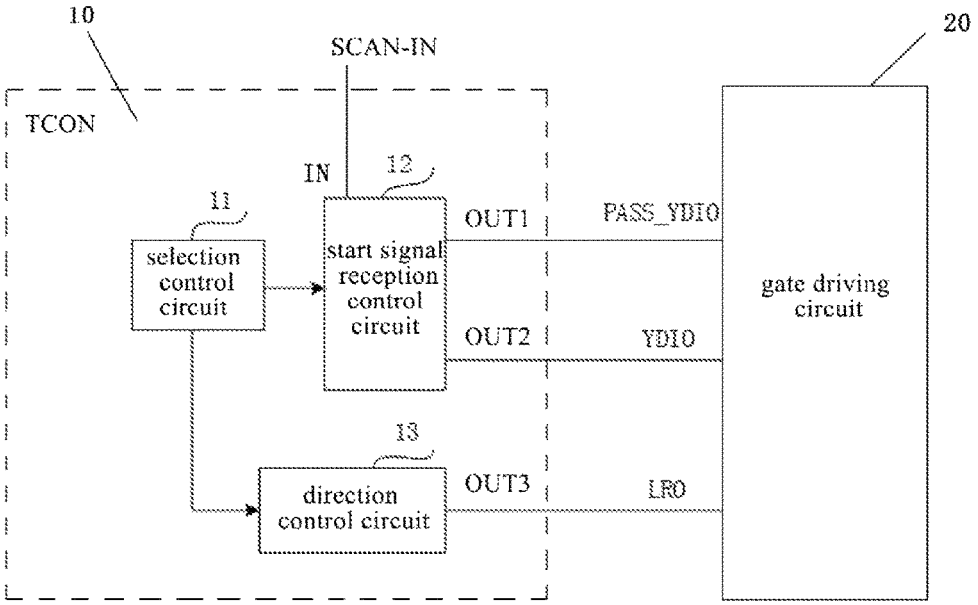
FIG. 1 is a schematic view showing a scanning direction control circuit according to one embodiment of the present disclosure.

As shown in FIG. 1, the present disclosure provides in some embodiments a scanning direction control circuit 10 for controlling a scanning direction of a gate driving circuit 20. The gate driving circuit 20 includes a forward scanning start signal input end PASS_YDIO, a backward scanning start signal input end YDIO and a scanning direction control end LRO. The scanning direction control circuit 10 includes a selection control circuit 11, a start signal reception control circuit 12 and a direction control circuit 13.

The selection control circuit 11 is coupled to the start signal reception control circuit 12 and the direction control circuit 13, and configured to output a first control signal to the start signal reception control circuit 12 and output a second control signal to the direction control circuit 13.

An input end IN of the start signal reception control circuit 12 is coupled to a scanning pulse signal input end SCAN_IN, and a first output end OUT1 and a second output end OUT2 thereof are coupled to the forward scanning start signal input end PASS_YDIO and the backward scanning start signal input end YDIO of the gate driving circuit, respectively. The start signal reception control circuit 12 is further coupled to the selection control circuit 11, and configured to, under the control of the first control signal from the selection control circuit 11, enable the scanning pulse signal input end SCAN_IN to be electrically coupled to the forward scanning start signal input end PASS_YDIO during forward scanning, and enable the scanning pulse signal input end SCAN_IN to be electrically coupled to the backward scanning start signal input end YDIO during backward scanning.

A third output end OUT3 of the direction control circuit 13 is coupled to the scanning direction control end LRO of the gate driving circuit. The direction control circuit 13 is further coupled to the selection control circuit 11, and configured to, under the control of the second control signal from the selection control circuit 11, output a forward scanning control signal to the scanning direction control end LRO during forward scanning, and output a backward scanning control signal to the scanning direction control end LRO during backward scanning.

In actual use, the gate driving circuit may be fixed onto a flexible circuit board through a COF technique.

In the embodiments of the present disclosure, the scanning direction control circuit includes the selection control circuit 11, the start signal reception control circuit 12 and the direction control circuit 13. The selection control circuit 11 outputs the first control signal to the start signal reception control circuit 12, and outputs the second control signal to the direction control circuit 13. Under the control of the first control signal, the start signal reception control circuit 12 is configured to enable the scanning pulse signal output end SCAN_IN to provide a scanning pulse signal to the forward scanning start signal input end PASS_YDIO during forward scanning, i.e., provide a start signal for a first-level shift register circuit of the gate driving circuit, so as to prepare for the forward scanning. During backward scanning, the start signal reception control circuit 12 is configured to enable the scanning pulse signal output end SCAN_IN to provide the scanning pulse signal to the backward scanning start signal input end YDIO, i.e., provide the start signal to a last-level shift register circuit of the gate driving circuit, so as to prepare for the backward scanning. Under the control of the second control signal, the direction control circuit 13 is configured to output the forward scanning control signal to the scanning direction control end LRO during forward scanning so as to enable the gate driving circuit to perform a forward scanning operation, and output the backward scanning control signal to the scanning direction control end LRO during backward scanning so as to enable the gate driving circuit to perform a backward scanning operation.

According to the scanning direction control circuit in the embodiments of the present disclosure, through the selection control circuit 11, the start signal reception control circuit 12 and the direction control circuit 13, it is able for the gate driving circuit to perform the forward scanning operation or the backward scanning operation quickly and conveniently.

In a possible embodiment of the present disclosure, the selection control circuit 11, the start signal reception control circuit 12 and the direction control circuit 13 are all arranged on a same time control circuit (TCON) board.

During the implementation, when the selection control circuit 11, the start signal reception control circuit 12 and the direction control circuit 13 are arranged on the same TCON board, it is unnecessary to load a program for backward scanning to another TCON board, thereby to improve the testing efficiency and the utilization of materials.

In the related art, it is impossible to provide a scanning direction control circuit on a same TCON board so as to achieve forward scanning control and backward scanning control simultaneously. Instead, the program for backward scanning needs to be loaded to another TCON board, so the testing efficiency and the utilization of the materials may be adversely affected. In the embodiments of the present disclosure, the selection control circuit 11, the start signal reception control circuit 12 and the direction control circuit 13 are arranged on the same TCON board, so it is able to provide the TCON board with more functions, enhance the light-on testing capability, and improve the testing efficiency.

To be specific, the selection control circuit 11 may include a selection switching module and a phase inversion module. A first input end of the selection switching module is configured to receive a high level signal, a second input end thereof is configured to receive a low level signal, and an output end thereof is coupled to an input end of the phase inversion module. The input end and an output end of the phase inversion module are coupled to the start signal reception control circuit, and the output end of the phase inversion module is further coupled to the direction control circuit. The selection switching module is configured to enable the first input end or the second input end to be electrically coupled to the output end of the selection switching module.

Figure 2:
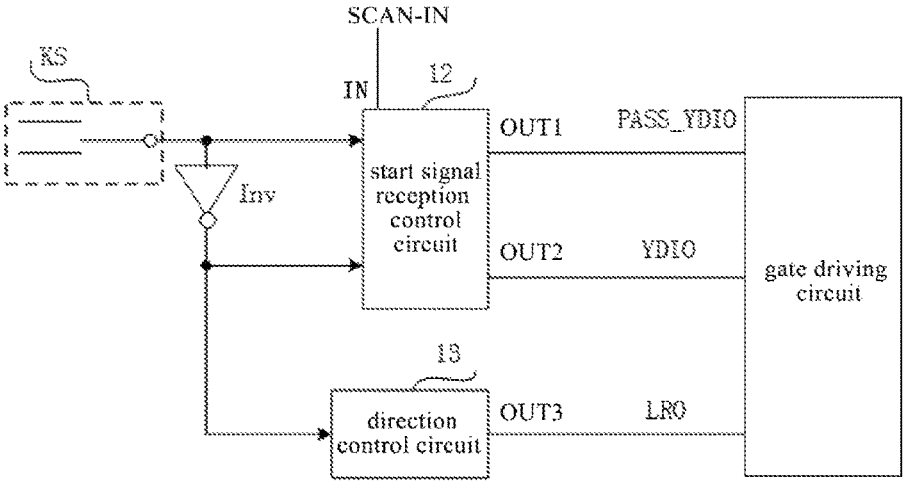
FIG. 2 is another schematic view showing the scanning direction control circuit according to one embodiment of the present disclosure.

As shown in FIG. 2, the selection switching module may include a switch KS, and the phase inversion module may include a phase inverter Inv. A first input end of the switch KS is configured to receive a high level signal, a second input end thereof is configured to receive a low level signal, and an output end thereof is coupled to an input end of the phase inverter Inv. The input end and an output end of the phase inverter Inv are coupled to the start signal reception control circuit 12, and the output end of the phase inverter Inv is further coupled to the direction control circuit 13.

To be specific, the start signal reception control circuit may include: a first D trigger, an input end of which is coupled to the scanning pulse signal input end, an enabling end of which is coupled to the output end of the selection switching module, and an output end of which is coupled to the forward scanning start signal input end; and a second D trigger, an input end of which is coupled to the scanning pulse signal input end, an enabling end of which is coupled to the output end of the phase inversion module, and an output end of which is coupled to the backward scanning start signal input end.

To be specific, the direction control circuit may include an AND gate module, a first input end of which is coupled to a scanning direction control signal input end, a second input end is coupled to the output end of the selection switching module, and an output end of which is coupled to the scanning direction control end.

During the implementation, when the gate driving circuit includes a left-side gate driving circuit and a right-side gate driving circuit, the scanning direction control signal input end includes a left-side scanning direction control signal input end and a right-side scanning direction control signal input end, and the scanning direction control end includes a left-side scanning direction control end and a right-side scanning direction control end. The AND gate module includes: a first AND gate, a first input end of which is coupled to the left-side scanning direction control signal input end, a second input end of which is coupled to the output end of the selection switching module, and an output end of which is coupled to the left-side scanning direction control end; and a second AND gate, a first input end of which is coupled to the right-side scanning direction control signal input end, a second input end of which is coupled to the output end of the selection switching module, and an output end of which is coupled to the right-side scanning direction control end.

The scanning direction control circuit will be described hereinafter in conjunction with the embodiments.

Figure 3:
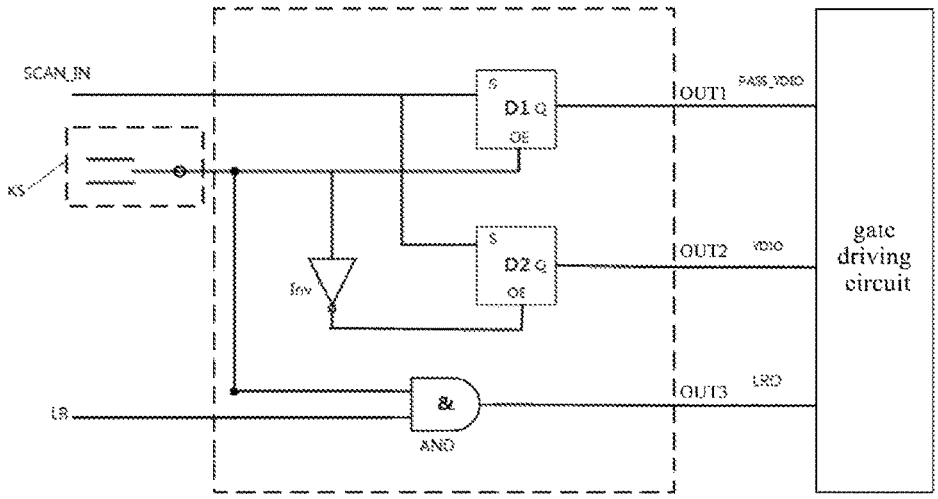
FIG. 3 is a circuit diagram of the scanning direction control circuit according to one embodiment of the present disclosure.

As shown in FIG. 3, in a first embodiment of the present disclosure, the scanning direction control circuit includes the selection control circuit 11, the start signal reception control circuit 12 and the direction control circuit 13. The selection control circuit 11 includes the switch KS and the phase inverter Inv. The first input end of the switch KS is configured to receive a high level signal, the second input end thereof is configured to receive a low level signal, and the output end thereof is coupled to the input end of the phase inverter Inv.

The start signal reception control circuit 12 includes: a first D trigger D1, an input end of which is coupled to the scanning pulse signal input end SCAN_IN, an enabling end of which is coupled to the output end of the switch KS, and an output end OUT1 of which is coupled to the forward scanning start signal input end PASS_YDIO; and a second D trigger D2, an input end of which is coupled to the scanning pulse signal input end SCAN_IN, an enabling end of which is coupled to the output end of the phase inverter Inv, and an output end OUT2 of which is coupled to the backward scanning start signal input end YDIO.

The direction control circuit 13 includes an AND gate, a first input end of which is coupled to a scanning direction control signal input end LR, a second input end is coupled to the output end of the switch KS, and an output end OUT3 of which is coupled to the scanning direction control end LRO.

In the first embodiment of the present disclosure, the switch KS is newly added on the TCON board, and the phase inverter Inv, the first D trigger D1, the second D trigger D2 and the AND gate are newly defined in a Field-Programmable Gate Array (FPGA) of the TCON board.

For each of the D trigger, sign "S" represents its input end, sign "Q" represents its output end and sign "OE" represents its enabling end.

During the operation of the scanning direction control circuit in the embodiment of the present disclosure, a scanning direction at a gate side (i.e., a scanning mode of the gate driving circuit) may be controlled through the switch KS.

To be specific, when output end of the switch KS is electrically coupled to the first input end of the switch KS, i.e., the output end of the switch KS outputs a high level signal "1", the phase inverter Inv outputs a low level signal "0". At this time, the enabling end of D1 receives the high level signal "1" and the enabling end of D2 receives the low level signal "0", so D1 works and D2 does not work, and the scanning pulse signal from SCAN_IN is applied to PASS_YDIO. The scanning direction control signal from LR is the high level signal "1", and a signal from the AND gate to the scanning direction control end LRO is also the high level signal "1", so as to control the gate driving circuit to perform the forward scanning operation.

In the case that the output end of the switch KS is electrically coupled to the second input end of the switch KS, i.e., the output end of the switch KS outputs the low level signal "0", the phase inverter Inv outputs the high level signal "1". At this time, the enabling end of D1 receives the low level signal "0" and the enabling end of D2 receives the high level signal "1", so D1 does not work and D2 works, and the scanning pulse signal from SCAN_IN is applied to YDIO. The scanning direction control signal from LR is the high level signal "1", and the signal from the AND gate to the scanning direction control end LRO is the low level signal "0", so as to control the gate driving circuit to perform the backward scanning operation.

According to the first embodiment of the present disclosure, the switch KS is newly added on the TCON board, and the phase inverter Inv, the first D trigger D1, the second D trigger D2 and the AND gate are newly defined in an FPGA of the TCON board. The switch KS outputs the high level signal or the low level signal, so as to change a scanning mode of the gate driving circuit. When the switch KS outputs the high level signal "1", the scanning pulse signal is applied to PASS_YDIO through D1, and meanwhile the AND gate outputs the high level signal "1" to LRO, so as to enable the gate driving circuit to perform the forward scanning operation, i.e., to scan, from up to bottom, multiple levels of shift register units of the gate driving circuit. When the switch KS outputs the low level signal "0" (i.e., a digital low level signal "0"), Inv outputs the high level signal "1" so as to apply the scanning pulse signal to YDIO through D2, and meanwhile the AND gate outputs the low level signal "0" to LRO, so as to enable the gate driving circuit to perform the backward scanning operation, i.e., to scan, from bottom to top, the multiple levels of shift register units of the gate driving circuit.

Figure 4:
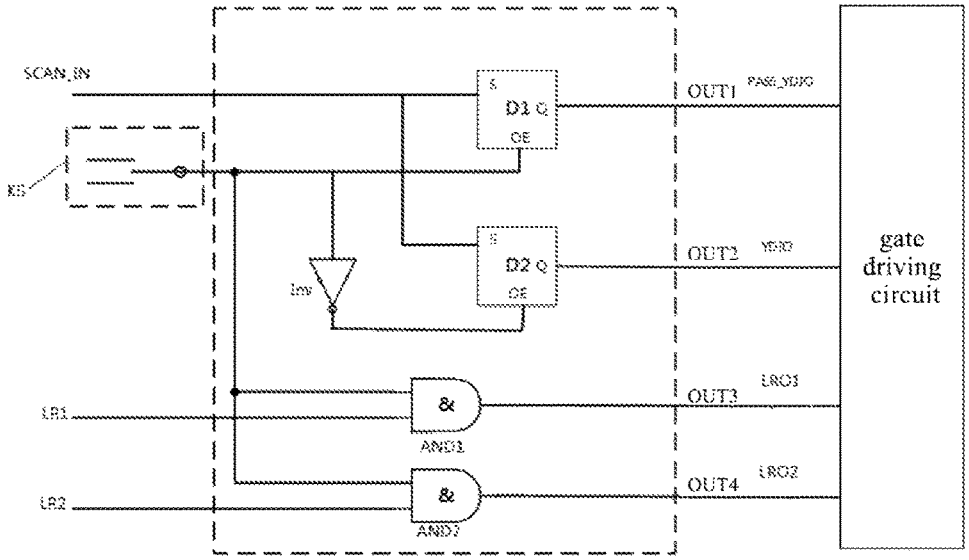
FIG. 4 is another circuit diagram of the scanning direction control circuit according to one embodiment of the present disclosure.

As shown in FIG. 4, in another embodiment of the present disclosure, the scanning direction control circuit is configured to control the scanning direction of the gate driving circuit. The gate driving circuit includes a left-side gate driving circuit and a right-side gate driving circuit. The scanning direction control signal input end includes a left-side scanning direction control signal input end LR1 and a right-side scanning direction control signal input end LR2. The scanning direction control end includes a left-side scanning direction control end LRO1 and a right-side scanning direction control end LRO2.

In the embodiment of the present disclosure, the scanning direction control circuit includes the selection control circuit 11, the start signal reception control circuit 12 and the direction control circuit 13. The selection control circuit 11 includes the switch KS and the phase inverter Inv. The first input end of the switch KS is configured to receive a high level signal, the second input end thereof is configured to receive a low level signal, and the output end thereof is coupled to the input end of the phase inverter Inv.

The start signal reception control circuit 12 includes: a first D trigger D1, an input end of which is coupled to the scanning pulse signal input end SCAN_IN, an enabling end of which is coupled to the output end of the switch KS, and an output end OUT1 of which is coupled to the forward scanning start signal input end PASS_YDIO; and a second D trigger D2, an input end of which is coupled to the scanning pulse signal input end SCAN_IN, an enabling end of which is coupled to the output end of the phase inverter Inv, and an output end OUT2 of which is coupled to the backward scanning start signal input end YDIO.

The direction control circuit 13 includes: a first AND gate AND1, a first input end of which is coupled to the left-side scanning direction control signal input end LR1, a second input end is coupled to the output end of the switch KS, and an output end OUT3 of which is coupled to the left-side scanning direction control end LRO1; and a second AND gate AND2, a first input end of which is coupled to the right-side scanning direction control signal input end LR2, a second input end of which is coupled to the output end of the switch KS, and an output end OUT4 of which is coupled to the right-side scanning direction control end LRO2.

In the second embodiment of the present disclosure, the switch KS is newly added on the TCON board, and the phase inverter Inv, the first D trigger D1, the second D trigger D2, the first AND gate AND1 and the second AND gate AND2 are newly defined in an FPGA of the TCON board.

During the operation of the scanning direction control circuit in the embodiment of the present disclosure, a scanning direction at a gate side (i.e., a scanning mode of the left-side gate driving circuit and a scanning mode of the right-side gate driving circuit) may be controlled through the switch KS.

To be specific, when output end of the switch KS is electrically coupled to the first input end of the switch KS, i.e., the output end of the switch KS outputs the high level signal "1", the phase inverter Inv outputs the low level signal "0". At this time, the enabling end of D1 receives the high level signal "1" and the enabling end of D2 receives the low level signal "0", so D1 works and D2 does not work, and the scanning pulse signal from SCAN_IN is applied to PASS_YDIO. The left-side scanning direction control signal from LR1 is the high level signal "1", and the right-side scanning direction control signal from LR2 is the high level signal "1". A signal from the first AND gate AND1 to the left-side scanning direction control end LRO1 is also the high level signal "1", so as to control the left-side gate driving circuit to perform the forward scanning operation. A signal from the second AND gate AND2 to the right-side scanning direction control end LRO2 is also the high level signal "1", so as to control the right-side gate driving circuit to perform the forward scanning operation.

When the output end of the switch KS is electrically coupled to the second input end of the switch KS, i.e., the output end of the switch KS outputs the low level signal "0", the phase inverter Inv outputs the high level signal "1". At this time, the enabling end of D1 receives the low level signal "0" and the enabling end of D2 receives the high level signal "1", so D1 does not work and D2 works, and the scanning pulse signal from SCAN_IN is applied to YDIO. The left-side scanning direction control signal from LR1 is the high level signal "1", and the right-side scanning direction control signal from LR2 is the high level signal "1". The signal from the first AND gate AND1 to the left-side scanning direction control end LRO1 is the low level signal "0", so as to control the left-side gate driving circuit to perform the backward scanning operation. The signal from the second AND gate AND2 to the right-side scanning direction control end LRO2 is also the low level signal "0", so as to control the right-side gate driving circuit to perform the backward scanning operation.

According to the embodiment of the present disclosure, the switch KS is newly added on the TCON board, and the phase inverter Inv, the first D trigger D1, the second D trigger D2, the first AND gate AND1 and the second AND gate AND2 are newly defined in an FPGA of the TCON board. The switch KS outputs the high level signal or the low level signal, so as to change a scanning mode of the gate driving circuit. When the switch KS outputs the high level signal "1", the scanning pulse signal is applied to PASS_YDIO through D1, and meanwhile the first AND gate AND1 outputs the high level signal "1" to LRO1, so as to enable the left-side gate driving circuit to perform the forward scanning operation, i.e., to scan, from up to bottom, multiple levels of shift register units of the left-side gate driving circuit. The second AND gate AND2 outputs the high level signal "1" to LRO2, so as to enable the right-side gate driving circuit to perform the forward scanning operation, i.e., to scan, from top to bottom, the multiple levels of shift register units of the right-side gate driving circuit. When the switch KS outputs the low level signal "0", Inv outputs the high level signal "1" so as to apply the scanning pulse signal to YDIO through D2, and meanwhile the first AND gate AND1 outputs the low level signal "0" to LRO1, so as to enable the left-side gate driving circuit to perform the backward scanning operation, i.e., to scan, from bottom to top, the multiple levels of shift register units of the left-side gate driving circuit. The second AND gate AND2 outputs the low level signal "0" to LRO2, so as to enable the right-side gate driving circuit to perform the backward scanning operation, i.e., to scan, from bottom to top, the multiple levels of shift register units of the right-side gate driving circuit.

Figure 5:
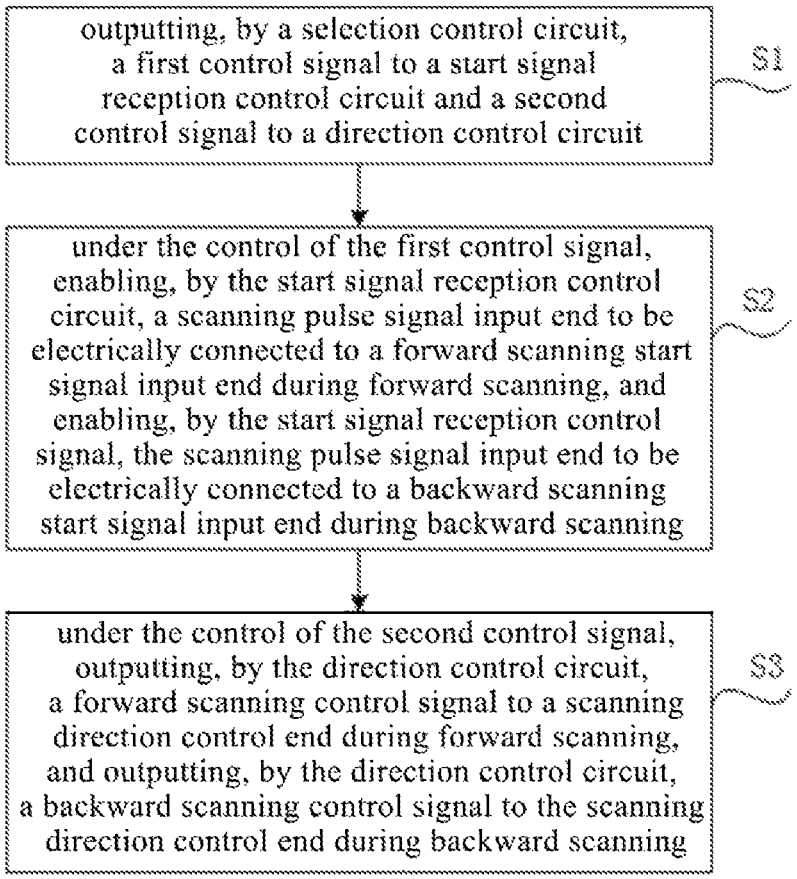
FIG. 5 is a flow chart of a method for driving the scanning direction control circuit according to one embodiment of the present disclosure.

As shown in FIG. 5, the present disclosure further provides in some embodiments a method for driving the above-mentioned scanning direction control circuit, including: Step S1 of outputting, by a selection control circuit, a first control signal to a start signal reception control circuit and a second control signal to a direction control circuit; Step S2 of, under the control of the first control signal, enabling, by the start signal reception control circuit, a scanning pulse signal input end to be electrically coupled to a forward scanning start signal input end during forward scanning, and enabling, by the start signal reception control signal, the scanning pulse signal input end to be electrically coupled to a backward scanning start signal input end during backward scanning; and Step S3 of, under the control of the second control signal, outputting, by the direction control circuit, a forward scanning control signal to a scanning direction control end during forward scanning, and outputting, by the direction control circuit, a backward scanning control signal to the scanning direction control end during backward scanning.

The present disclosure further provides in some embodiments a light-on testing device for performing a light-on test through controlling a gate driving circuit. The gate driving circuit includes a forward scanning start signal input end, a backward scanning start signal input end and a scanning direction control end. The light-on testing device includes the above-mentioned scanning direction control circuit. The scanning direction control circuit is coupled to the forward scanning start signal input end, the backward scanning start signal input end and the scanning direction control end of the gate driving circuit.

In actual use, the light-on testing device further includes a time control circuit board on which a selection control circuit, a start signal reception control circuit and a direction circuit are arranged.

According to the embodiments of the present disclosure, the selection control circuit, the start signal reception control circuit and the direction control circuit are arranged on a same TCON board. As a result, it is unnecessary to load a program for backward scanning to another TCON board, thereby to improve the efficiency of the light-on testing and the utilization of materials.

The present disclosure further provides in some embodiments a display device including the above-mentioned scanning direction control circuit. The display device may be any product or member having a display function, such as a liquid crystal display panel, an electronic paper, an organic light-emitting diode (OLED), a mobile phone, a flat-panel computer, a television, a display, a laptop computer, a digital photo frame or a navigator.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A scanning direction control circuit for controlling a scanning direction of a gate driving circuit, wherein the gate driving circuit comprises a forward scanning start signal input end, a backward scanning start signal input end and a scanning direction control end;

the scanning direction control circuit comprises a selection control circuit, a start signal reception control circuit and a direction control circuit;

the selection control circuit is configured to output a first control signal to the start signal reception control circuit and output a second control signal to the direction control circuit;

the start signal reception control circuit is configured to, under the control of the first control signal, enable a scanning pulse signal input end to be electrically coupled to the forward scanning start signal input end during forward scanning, and enable the scanning pulse signal input end to be electrically coupled to the backward scanning start signal input end during backward scanning; and the direction control circuit is configured to, under the control of the second control signal, output a forward scanning control signal to the scanning direction control end during forward scanning, and output a backward scanning control signal to the scanning direction control end during backward scanning.

2. The scanning direction control circuit according to claim 1, wherein the selection control circuit, the start signal reception control circuit and the direction control circuit are arranged on a same time control circuit board.

3. The scanning direction control circuit according to claim 1, wherein the selection control circuit comprises a selection switching module and a phase inversion module;

a first input end of the selection switching module is configured to receive a high level signal, a second input end thereof is configured to receive a low level signal, and an output end thereof is coupled to an input end of the phase inversion module;

the input end and an output end of the phase inversion module are coupled to the start signal reception control circuit, and the output end of the phase inversion module is further coupled to the direction control circuit; and the selection switching module is configured to enable the first input end or the second input end to be electrically coupled to the output end of the selection switching module.

4. The scanning direction control circuit according to claim 3, wherein the start signal reception control circuit comprises:

a first D trigger, an input end of which is coupled to the scanning pulse signal input end, an enabling end of which is coupled to the output end of the selection switching module, and an output end of which is coupled to the forward scanning start signal input end; and a second D trigger, an input end of which is coupled to the scanning pulse signal input end, an enabling end of which is coupled to the output end of the phase inversion module, and an output end of which is coupled to the backward scanning start signal input end.

5. The scanning direction control circuit according to claim 3, wherein the direction control circuit comprises an AND gate module, a first input end of which is coupled to a scanning direction control signal input end, a second input end is coupled to the output end of the selection switching module, and an output end of which is coupled to the scanning direction control end.

6. The scanning direction control circuit according to claim 5, wherein when the gate driving circuit comprises a left-side gate driving circuit and a right-side gate driving circuit, the scanning direction control signal input end includes a left-side scanning direction control signal input end and a right-side scanning direction control signal input end, and the scanning direction control end includes a left-side scanning direction control end and a right-side scanning direction control end, wherein the AND gate module comprises:

a first AND gate, a first input end of which is coupled to the left-side scanning direction control signal input end, a second input end of which is coupled to the output end of the selection switching module, and an output end of which is coupled to the left-side scanning direction control end; and a second AND gate, a first input end of which is coupled to the right-side scanning direction control signal input end, a second input end of which is coupled to the output end of the selection switching module, and an output end of which is coupled to the right-side scanning direction control end.

7. The scanning direction control circuit according to claim 2, wherein the selection control circuit comprises a selection switching module and a phase inversion module;

a first input end of the selection switching module is configured to receive a high level signal, a second input end thereof is configured to receive a low level signal, and an output end thereof is coupled to an input end of the phase inversion module;

the input end and an output end of the phase inversion module are coupled to the start signal reception control circuit, and the output end of the phase inversion module is further coupled to the direction control circuit; and the selection switching module is configured to enable the first input end or the second input end to be electrically coupled to the output end of the selection switching module.

8. A method for driving the scanning direction control circuit according to claim 1, comprising steps of:

outputting, by a selection control circuit, a first control signal to a start signal reception control circuit and a second control signal to a direction control circuit;

under the control of the first control signal, enabling, by the start signal reception control circuit, a scanning pulse signal input end to be electrically coupled to a forward scanning start signal input end during forward scanning, and enabling, by the start signal reception control signal, the scanning pulse signal input end to be electrically coupled to a backward scanning start signal input end during backward scanning; and under the control of the second control signal, outputting, by the direction control circuit, a forward scanning control signal to a scanning direction control end during forward scanning, and outputting, by the direction control circuit, a backward scanning control signal to the scanning direction control end during backward scanning.

9. A light-on testing device for performing a light-on test through controlling a gate driving circuit, wherein the gate driving circuit comprises a forward scanning start signal input end, a backward scanning start signal input end and a scanning direction control end, the light-on testing device comprises the scanning direction control circuit according to claim 1, and the scanning direction control circuit is coupled to the forward scanning start signal input end, the backward scanning start signal input end and the scanning direction control end.

10. The light-on testing device according to claim 9, further comprising a time control circuit board on which a selection control circuit, a start signal reception control circuit and a direction circuit are arranged.

11. The light-on testing device according to claim 9, wherein the selection control circuit comprises a selection switching module and a phase inversion module;

a first input end of the selection switching module is configured to receive a high level signal, a second input end thereof is configured to receive a low level signal, and an output end thereof is coupled to an input end of the phase inversion module;

the input end and an output end of the phase inversion module are coupled to the start signal reception control circuit, and the output end of the phase inversion module is further coupled to the direction control circuit; and the selection switching module is configured to enable the first input end or the second input end to be electrically coupled to the output end of the selection switching module.

12. The light-on testing device according to claim 11, wherein the start signal reception control circuit comprises:

a first D trigger, an input end of which is coupled to the scanning pulse signal input end, an enabling end of which is coupled to the output end of the selection switching module, and an output end of which is coupled to the forward scanning start signal input end; and a second D trigger, an input end of which is coupled to the scanning pulse signal input end, an enabling end of which is coupled to the output end of the phase inversion module, and an output end of which is coupled to the backward scanning start signal input end.

13. The light-on testing device according to claim 11, wherein the direction control circuit comprises an AND gate module, a first input end of which is coupled to a scanning direction control signal input end, a second input end is coupled to the output end of the selection switching module, and an output end of which is coupled to the scanning direction control end.

14. The light-on testing device according to claim 13, wherein when the gate driving circuit comprises a left-side gate driving circuit and a right-side gate driving circuit, the scanning direction control signal input end includes a left-side scanning direction control signal input end and a right-side scanning direction control signal input end, and the scanning direction control end includes a left-side scanning direction control end and a right-side scanning direction control end, wherein the AND gate module comprises:

a first AND gate, a first input end of which is coupled to the left-side scanning direction control signal input end, a second input end of which is coupled to the output end of the selection switching module, and an output end of which is coupled to the left-side scanning direction control end; and a second AND gate, a first input end of which is coupled to the right-side scanning direction control signal input end, a second input end of which is coupled to the output end of the selection switching module, and an output end of which is coupled to the right-side scanning direction control end.

15. A display device comprising the scanning direction control circuit according to claim 1.

* * * * *